US006060832A

United States Patent [19]

Adler et al.

[11] Patent Number: 6,060,832

[45] Date of Patent: May 9, 2000

[54] SELF-BIASING COLLECTOR ELEMENTS FOR LINEAR-BEAM MICROWAVE TUBES

[75] Inventors: E. Allen Adler, Los Angeles; Ivo Tammaru; Robert G. Ripley, both of Rancho Palos Verdes, all of Calif.

[73] Assignee: Hughes Electronics Corporation, El Segundo, Calif.

[21] Appl. No.: 08/924,201

[22] Filed: Jul. 24, 1997

[51] Int. Cl.[7] ..... H01J 23/02

[52] U.S. Cl. ..... 315/5.38

[58] Field of Search ..... 315/5.38

[56] References Cited

U.S. PATENT DOCUMENTS

| | | | |
|---|---|---|---|
| 2,568,325 | 9/1951 | Diamond | 315/5.38 X |
| 3,381,162 | 4/1968 | Schwartz et al. | 315/5.38 |
| 3,448,324 | 6/1969 | Eggers et al. | 315/5.38 X |
| 4,250,430 | 2/1981 | Heynisch | 315/5.38 |
| 4,607,193 | 8/1986 | Curren et al. | 315/5.38 |

FOREIGN PATENT DOCUMENTS

| | | | |
|---|---|---|---|
| 2742580A | 6/1997 | France . | |
| 939 | 1/1988 | Japan | 315/5.38 |
| 5-94777 | 10/1991 | Japan . | |

OTHER PUBLICATIONS

NASA Tech. Briefs, Document No. XP002084136 Graphite Multistage Depressed Collector for Microwave Tubes: No. 164, Mar. 1988, Springfiled VA, USA *p. 1, left hand column.

Pierce, J.R., *Theory and Design of Electron Beams*, D. Van Nostrand and Company, New York, 1954, pp. 72–75.

Hansen, James, W, et al., *TWT/TWTA Handbook*, Hughes Aircraft Company, 1993, Torrance, CA, pp. 58–59.

*Primary Examiner*—Benny T. Lee

*Attorney, Agent, or Firm*—Bradley K. Lortz; Vijayalakshmi D. Duraiswamy

[57] ABSTRACT

A self-biasing element is formed by coupling an electron accumulator to a collector stage of a linear-beam microwave tube with a base which has a selected resistance. The electron accumulator has a secondary emission coefficient less than one and is positioned to intercept a portion of the electrons in the electron beam of the linear-beam microwave tube. The electron accumulator thus acquires a negative voltage whose magnitude is controlled by selecting the base resistance and the radial and axial position of the self-biasing element within the collector. Various arrangements of self-biasing elements and collector stages are disclosed which improve the efficiency and RF performance of the microwave tube.

19 Claims, 6 Drawing Sheets

SELF-BIASING COLLECTOR ELEMENTS FOR LINEAR-BEAM MICROWAVE TUBES

BACKGROUND OF THE INVENTION

1. Field of the Invention

The present invention relates generally to linear-beam microwave tubes and, more particularly, to collectors for linear-beam microwave tubes. For descriptive purposes, a traveling-wave tube is used as an exemplary linear-beam microwave tube.

2. Description of the Related Art

An exemplary linear-beam microwave tube in the form of a traveling-wave tube (TWT) 20 is illustrated in FIG. 1. The elements of the TWT 20 are generally coaxially arranged along a TWT axis 21. They include an electron gun 22, a microwave structure in the form of a slow-wave structure 24 (embodiments of which are shown in FIGS. 2A and 2B), a beam-focusing structure 26 which surrounds the slow-wave structure 24, a signal input port 28 and a signal output port 30 which are coupled to opposite ends of the slow-wave structure 24 and a collector 32. A housing 34 typically extends from the collector 32 to protect the other TWT elements.

In operation, a beam of electrons is launched from the electron gun 22 into the slow-wave structure 24 and is guided through that structure by the beam-focusing structure 26. A microwave input signal 36 is inserted at the input port 28 and moves along the slow-wave structure to the signal output port 30. The slow-wave structure 24 causes the axial velocity of microwave signal propagation to approximate the velocity of the electron beam.

As a result, the beam's electrons are velocity-modulated into bunches which interact with the microwave signal. In this process, kinetic energy is transferred from the electrons to the microwave signal; the signal is amplified and is coupled from the signal output port 30 as an amplified signal 38. After their passage through the slow-wave structure 24, the beam's electrons are collected in the collector 32.

The beam-focusing structure 26 is typically configured to develop an axial magnetic field. A first configuration includes a series of annular, coaxially arranged permanent magnets 40 which are separated by pole pieces 41. The magnets 40 are arranged so that the opposed faces of adjacent magnets have opposite magnetic polarities. This beam-focusing structure is comparatively light weight and is generally referred to as a periodic permanent magnet (PPM) structure. In TWTs in which output power is more important than size and weight, a second beam-focusing configuration often replaces the PPM structure with a solenoid 42 (partially shown adjacent the input port 28) which carries a current supplied by a solenoid power supply (not shown).

As shown in FIGS. 2A and 2B, TWT slow-wave structures generally receive an electron beam 52 from the electron gun (22 in FIG. 1) into an axially-repetitive structure. A first exemplary slow-wave structure is the helix 43 shown in FIG. 2A. A second exemplary slow-wave structure is the coupled-cavity circuit 44 shown in FIG. 2B. The coupled-cavity circuit includes annular webs 46 which are axially spaced to form cavities 48. Each of the webs 46 forms a coupling hole 50 which couples a pair of adjacent cavities. The helix 43 is especially suited for broad-band applications while the coupled-cavity circuit is especially suited for high-power applications.

In another conventional TWT configuration, an oscillator is formed by replacing the output port 30 with a microwave load. Random, thermally generated noise interacts with the electron beam on the slow-wave structure 24 to generate a microwave signal. Energy is transferred to this signal as it moves along the slow-wave structure. This oscillator signal generally travels in an opposite direction to that of the electron beam (i.e., the TWT functions as a backward-wave oscillator) so that the oscillator signal is coupled from the port 28.

TWTs are capable of amplifying and generating microwave signals over a considerable frequency range (e.g., 1–20 GHz). They can generate high output powers (e.g., >10 megawatts) and achieve large signal gains (e.g., 60 dB) over broad bandwidths (e.g., >10%).

The electron gun 22, the helix 43 and the collector 32 are again shown in the schematic of FIG. 3 which illustrates details of the TWT 20 of FIG. 1 (for clarity of illustration, only a simple representation of the helix 43 is depicted). The electron gun 22 has a cathode 56 and an anode 58 and the collector 32 has a first annular stage 60, a second annular stage 62 and a third stage 64. Because the third stage 64 generally has a cup-like or bucket-like form, it is sometimes referred to as the "bucket" or "bucket stage".

The helix 43 and a body 70 of the TWT are at ground potential. The cathode 56 is connected to the negative (−) lead of a cathode power supply 74 that generates a voltage $V_{cath}$ and has its positive lead (+) connected to ground. The negative lead (−) of an anode power supply 76 is referenced to the cathode 56 and a positive lead (+) is coupled to the anode 58. This positive cathode-anode voltage establishes an accelerating electric field across an acceleration region 78 between the cathode 56 and the anode 58. Electrons are emitted by the cathode 56 and accelerated across the acceleration region 78 to form an electron beam 52. The beam 52 is further modified by the electric field established by the potential difference between the anode 56 and the grounded helix 43.

The total acceleration voltage of the electron beam 52 is the cathode-to-helix voltage difference (ignoring the small voltage difference that exists between the beam axis and the helix as a result of the negative charge in the electron beam). Since the helix 43 is at ground potential, the beam acceleration voltage is just the absolute value of the cathode voltage $V_{cath}$.

When an electron, with mass me and initially at rest, is accelerated by electrostatic fields through a potential difference of V, its resultant kinetic energy is given by $0.5\ m_e v^2 = eV$, in which v is the electron velocity and e is the electronic charge. The kinetic energy divided by the electronic charge e is therefore equivalent to a voltage. Conventionally, an electron that has been accelerated through a voltage difference of V is said to have acquired a kinetic energy of V volts.

The electron beam 52 travels through the slow-wave structure 43 and exchanges energy with a microwave signal which travels along the slow-wave structure 43 from an input port 28 to an output port 30. Only a portion of the kinetic energy of the electron beam 52 is lost in this energy exchange. Most of the kinetic energy remains in the electron beam 52 as it enters the collector 32. A significant part of this kinetic energy can be recovered by decelerating the electrons before they are collected at the collector walls.

Because of their negative charge, the electrons of the electron beam 52 form a negative "space charge" which would radially disperse the electron beam 52 in the absence of any external restraint. Accordingly, the beam-focusing structure applies an axially-directed magnetic field which restrains the radial divergence of electrons by causing them to spiral about the beam.

However, the electron beam 52 is no longer under this radial restraint when it enters the collector 32 and, consequently, it begins to radially disperse. In addition, the interaction between the electron beam 52 and the microwave signal on the slow-wave structure 43 causes the beam's electrons to have a "velocity spread" as they enter the collector 32, i.e., the electrons have a range of velocities and kinetic energies. When the beam travels a given axial distance in the collector 32, the slower electrons are exposed to the divergent force of the electron beam's space charge for a greater time than are faster electrons. Therefore, at a given axial plane and away from the region near the axis where the radial force is small, the energy of electrons within the collector 32 generally decreases with increased radial distance.

Electron deceleration is achieved by application of negative biasing voltages to the collector (by way of feedthroughs 87 in FIG. 1). The potential of the collector is "depressed" from that of the TWT body 70 (i.e., made negative relative to the body 70). The kinetic energy recovery is further enhanced by using a multistage collector, e.g., the collector 32, in which each successive stage is further depressed from the body potential of $V_B$. For example, if the first collector stage 60 has a potential $V_1$, the second collector stage 62 a potential $V_2$ and the third collector stage 64 a potential of $V_3$, these potentials are related by $V_B=0>V_1>V_2>V_3$ as indicated in FIG. 3.

The voltage $V_1$ on the first stage 60 is typically depressed to a value that will maximally decelerate but still collect the slowest electrons 80 in the electron beam 52. Sometimes, if there are only a few low-energy electrons in the entering beam 52, higher overall efficiency can be obtained if the first stage 60 is depressed even more. The slowest electrons then have insufficient energy to enter the region of the first stage 60; these electrons are forced to turn around and return to the body potential, either on the region 70 of FIG. 3 or on the grounded helix 43. Higher overall efficiency results if, with greater depression, the increase in energy recovered from the more energetic electrons exceeds the energy lost by collecting the slowest electrons at ground potential.

Successive collector stages 62 and 64 are operated with increasingly depressed voltages to decelerate and collect successively faster electrons in the electron beam 52, e.g., intermediate-energy electrons 82 are collected by collector stage 62 and high-energy electrons 84 are collected by collector stage 64. This process of improving TWT efficiency by decelerating and collecting successively faster electrons with successively greater depression on successive collector stages is generally referred to as "velocity sorting" (velocity sorting is described in many TWT references, e.g., see Hansen, James, W, et al., *TWT/TWTA Handbook*, Hughes Aircraft Company, 1993, Torrance, Calif., pp. 58–59).

The efficiency enhancement realized by velocity sorting of the electron beam 52 can be further understood with reference to current flows through a collector power supply 88 whose negative lead (−) is coupled to the negative lead (−) of the cathode power supply 74 and whose positive leads (+) are coupled to the collector stages 60, 62 and 64. If the potential of the collector 32 were the same as the collector body 70, the total collector electron current $I_{coll}$ would flow back to the cathode power supply 74 as indicated by the current 90 in FIG. 3, and the input power to the TWT 20 would substantially be the product of the cathode voltage $V_{cath}$ and the collector current $I_{coll}$.

In contrast, the currents of the multistage collector 32 flow through the collector power supply 88. The input power associated with each collector stage is the product of that stage's current and its associated voltage in the collector power supply 88. Because the voltages $V_1$, $V_2$ and $V_3$ of the collector power supply 88 are a fraction (e.g., in the range of 30–70%) of the voltage of the cathode power supply 74, the TWT input power is effectively decreased. Efficiencies of TWTs with multistage collectors are typically in the range of 25–60%, with higher efficiency generally associated with narrower bandwidth.

If the voltage on a collector stage is depressed too far, electrons will be repelled from the stage rather than being collected by it. Axially-located electrons are especially vulnerable to this rejection. These repelled electrons flow to less-depressed stages or to the TWT body or they may reenter the energy exchange area of the slow-wave structure. In addition, secondary electrons are generated when the electron beam's electrons strike the surfaces of the collector stages. If not properly controlled by the electric fields within the collector, these secondary electrons may also flow to the TWT body 70 or they may reenter the energy exchange area.

Electron rejection to less-depressed stages or to the TWT body reduces the TWT's efficiency. Electron flow to the slow-wave structure interferes with the energy exchange process. This interference often degrades TWT performance by adding gain and phase ripple components over the TWT's frequency bandwidth.

Various collector structures have been introduced to enhance the flow of primary electrons to more-depressed collector stages and to block the flow of secondary electrons from the collector. These structures include transverse vanes, axial probes, external magnets and slanted collector apertures. However, implementing vanes is often mechanically or thermally difficult, probes require the generation and application of additional bias voltages, external magnets require additional test time to properly locate and attach them and slanted apertures are only effective for small apertures.

SUMMARY OF THE INVENTION

The present invention is directed to collector structures which facilitate control of electron paths without requiring the generation and application of additional power supply voltages. These collector structures are intended for use in linear-beam microwave tubes, e.g., TWT's.

This goal is achieved with the recognition that 1) a collector member with a secondary emission coefficient that is less than one can accumulate electrons (and, hence, a negative voltage) by intercepting a portion of the electrons of an electron beam, and 2) such an electron accumulator can be positioned within a collector to control the path of other electrons with its negative voltage. It is additionally recognized that the magnitude of the negative voltage can be selected by positioning the electron accumulator to intercept electrons of selected energies and by leaking electrons from the electron accumulator to adjacent collector stages.

In one collector embodiment, a self-biasing element is formed by coupling the electron accumulator to an adjacent collector stage with a base whose resistance determines the electron leakage. In other collector embodiments, the negative voltage is determined by the radial and axial position of the self-biasing element.

Electron accumulator embodiments are formed with carbon and titanium carbide. Base embodiments are formed of ceramics whose resistance is selected by mixing the ceramic with a conductive component or by shunting the base with a conductive film or a discrete resistor.

Various collector embodiments are formed with different arrangements of self-biasing elements and collector stages to improve efficiency and RF performance of linear-beam microwave tubes.

The novel features of the invention are set forth with particularity in the appended claims. The invention will be best understood from the following description when read in conjunction with the accompanying drawings.

DETAILED DESCRIPTION OF THE PREFERRED EMBODIMENTS

Figure 4:
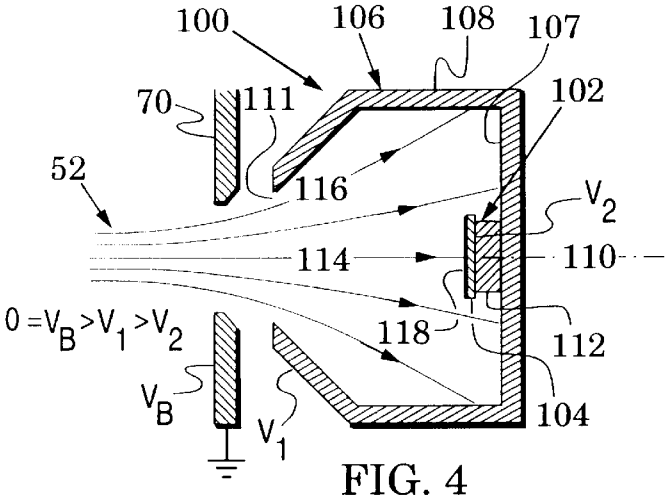
FIG. 4 is an axially-sectioned view of a collector which has a self-biasing element in accordance with the present invention.

FIG. 4 illustrates a collector 100 in accordance with the present invention. The collector 100 has a self-biasing element 102 which includes an electron accumulator 104 that has a secondary-emission coefficient less than one. The electron accumulator 104 is positioned in the collector to intercept a portion of the electrons of an electron beam 52, capture some of these electrons and hold them in place and thereby create and maintain a negative voltage. The self-biasing element 102 is further positioned in the collector 100 to block secondary electrons from entering the RF circuit (24 in FIG. 1) of a linear-beam microwave tube. The self-biasing element 102 requires no externally-generated voltage and can reduce the size and weight of the collector 100.

In more detail, the collector 100 has a cup-shaped collector stage 106 (a bucket stage) which is formed by a floor 107 and an annular rim 108 that extends from the floor 107 along a collector axis 110. At an end opposite the floor 107, the annular rim 108 forms an entrance aperture 111 which is adjacent body 70 (also shown in FIG. 3) of a linear-beam microwave tube. The self-biasing element 102 is positioned on the collector axis 110 and is coupled to the floor 107 by a base 112. Thus, the collector stage 106 is configured to collect a first, major portion of the electrons of the electron beam 52 and the electron accumulator 104 is sized and positioned to intercept a second, lesser portion of the electrons of the electron beam 52.

When an electron is incident upon a member, its energy can cause the emission of "secondary electrons" from that member. The ratio of secondary electrons to incident electrons is conventionally referred to as the secondary-emission coefficient $\epsilon$. The electron accumulator 104 of FIG. 4 is configured to have a selected secondary-emission coefficient $\epsilon_{acc}$ which is less than one and the base 112 is configured to have a selected leakage resistance $R_{leak}$ between the electron accumulator 104 and the collector stage 106.

Figure 1:
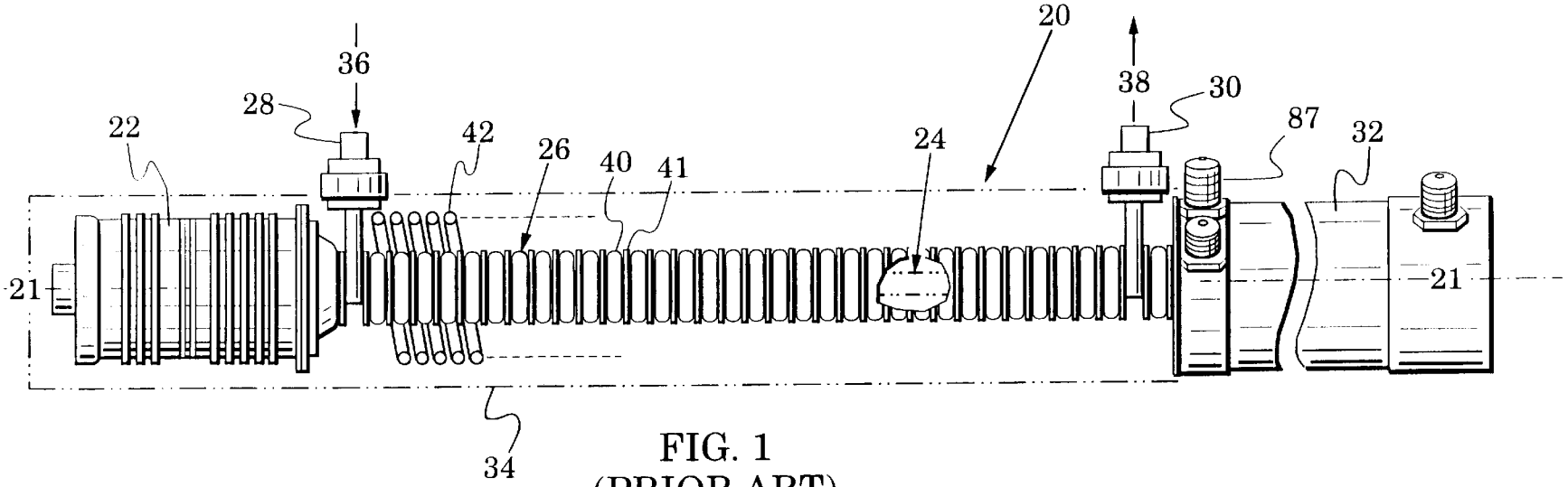
FIG. 1 (PRIOR ART)
FIG. 1 is a partially-sectioned side view of a conventional traveling-wave tube (TWT)
Figure 3:
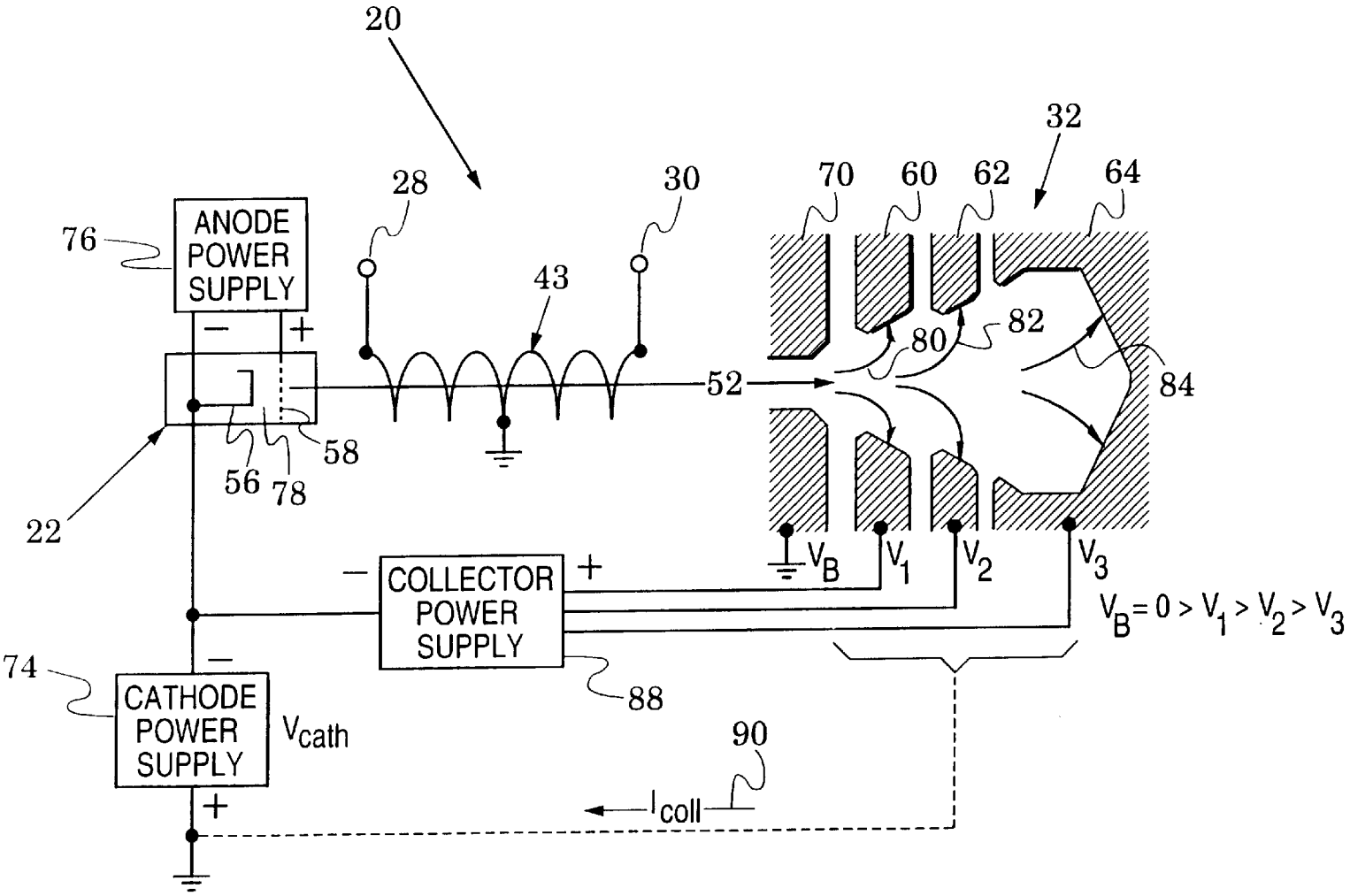
FIG. 3 (PRIOR ART)
FIG. 3 is a schematic of the TWT of FIG. 1 which shows an axially-sectioned, conventional multistage collector.

In its operation, the collector 100 replaces the collector 32 of FIG. 1 and receives the electron beam 52 of FIG. 3. After entering the collector 100, the electron beam 52 diverges because it is no longer under the radial restraint of the beam-focusing structure (26 or 42 in FIG. 1). The body 70 has a body voltage $V_B$=0 and a power supply (e.g., the collector power supply 88 of FIG. 3) which causes the collector stage 106 to have a depressed voltage $V_1$ that is less than $V_B$.

Because the electron accumulator 104 has a secondary emission coefficient less than one, electrons accumulate on it and charge it negatively to a depressed voltage $V_2$. The maximum value of $V_2$ is a function of the energy of the incident electrons. The depressed voltage will increase to approximately the maximum energy of the incident electrons but will not exceed this energy because a greater depressed voltage will repel further incidence of electrons (i.e., the deceleration of these electrons would be too great to permit their collection). Because the electrons of the electron beam 52 have a radial spread of energies and continue to diverge along the collector axis 110, the maximum value of $V_2$ depends upon the radial and axial position electron accumulator 104. For example, the maximum value of $V_2$ will be greater if the electron accumulator is positioned to intercept electrons 114 in FIG. 4 than if positioned to intercept electrons 116 in FIG. 4.

The actual differential $\Delta V$ between the depressed voltage of the electron accumulator 104 and that of the collector stage 106 to which it is coupled ($V_2$–$V_1$ in FIG. 4) by its base 112, is given by $$\Delta V=(1-\epsilon_{acc})I_{int}R_{leak} \quad (1)$$

in which $I_{int}$ is the electron interception current of the electron accumulator 104. The interception current $I_{int}$ is a function of the energy of the intercepted electrons and of the depressed voltage of the electron accumulator. Therefore, the differential voltage ΔV of equation (1) is not directly proportional to the leakage resistance $R_{leak}$.

The differential voltage ΔV can thus be adjusted by selection of the secondary-emission coefficient $\epsilon_{acc}$, the leakage resistance $R_{leak}$ and the radial and axial position of the electron accumulator 104. Because of the differential voltage ΔV, the depressed voltages in FIG. 4 will have the relationship of $0=V_B<V_1<V_2$.

As an example of the use of equation (1), an electron accumulator with a secondary-emission coefficient of 0.5 that receives an intercept current $I_{int}$ of 2 milliamps will develop a differential depressed voltage ΔV of ~100 volts when it is coupled by a base which is one centimeter square and 0.5 centimeter thick and which has a resistivity of $2\times10^5$ ohm-centimeter.

The electron accumulator 104 can be formed of various materials whose secondary-emission coefficients $\epsilon_{acc}$ are less than one, e.g., carbon and titanium carbide which have coefficients respectively of −0.5 and ~0.6. In other embodiments, the electron accumulator can be formed with a coating of such a material over a support member of a high-impedance material, e.g., a ceramic. In this embodiment of the electron accumulator, the reference number 104 in FIG. 4 becomes the support member and it carries a coating 118 on its surface which receives the incident electrons 114.

The leakage resistance $R_{leak}$ can be controlled by selecting the material of the base 112. Preferably, the base 112 is formed of a material which is easily bonded in place and has excellent heat tolerance. An exemplary base material is ceramic, which is commonly brazed to collector parts with an intervening metallic layer. Ceramics have high resistivities, e.g., the intrinsic resistivity of alumina, beryllia and magnesium oxide is $>10^{14}$ ohm-centimeter. These ceramic resistivities can be selectively lowered by mixing a ceramic component with a more conductive component. An exemplary conductive component is silicon carbide whose resistivity is on the order of $10^3$ ohm-centimeter. An exemplary combination of these components is a mixture in the proportions of 60% magnesium oxide and 40% silicon carbide. The resistivity of this mixture has been measured to be ~$10^7$ ohm-centimeter.

Figure 5:
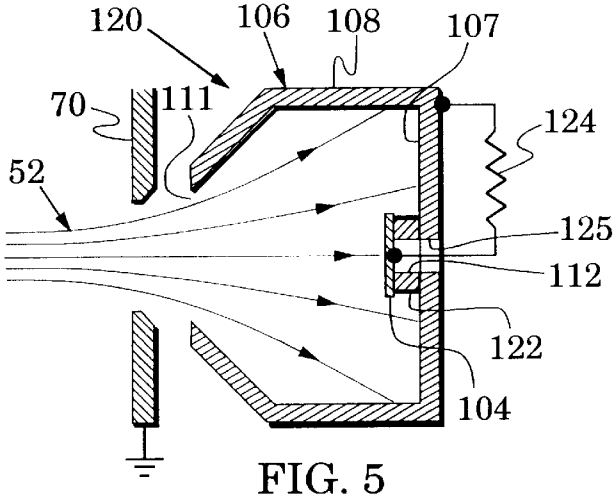
FIG. 5 is an axially-sectioned view of a collector which has another self-biasing element.

The leakage resistance $R_{leak}$ can also be controlled by adding a shunt resistance to the base. For example, a collector 120 is shown in FIG. 5, which is a view similar to FIG. 4 with like elements indicated by like reference numbers which will not be further discussed in detail for this Figure. This figure shows two shunt structures which can be used to selectively lower and set the leakage resistance $R_{leak}$ of the base 112. The first structure is a coating 122 over the base 112 of a material, e.g., carbon, which provides the desired resistance by an appropriate selection of the coating density or coating pattern. The second structure is a discrete resistor 124 which has a selected resistance. Access for connecting the resistor 124 to the electron accumulator 104 can be gained via a passage 125 through the base 112 and the collector floor 107.

Self-biasing elements of the invention can be configured in a variety of arrangements which can be advantageously used to improve the efficiency and RF performance of linear-beam microwave tubes. Several exemplary arrangements are described below under separate functional headings.

Improving Linear-Beam Microwave Tube Efficiency with Secondary Emission Control

Figure 6C:
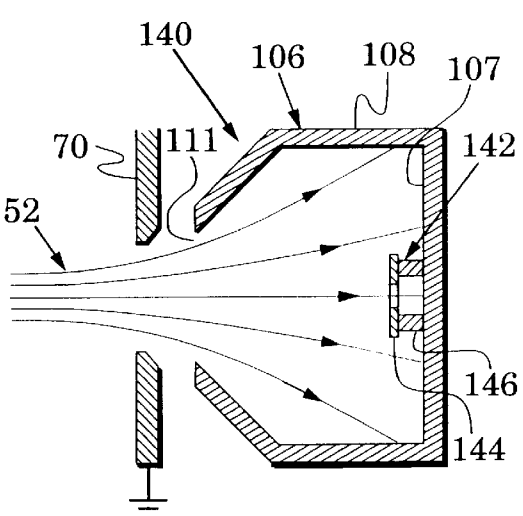
FIG. 6C is an axially-sectioned view of a collector which has another self-biasing element.
Figure 6B:
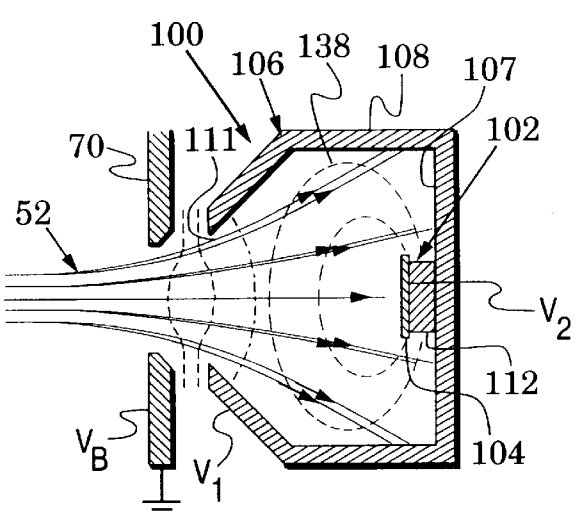
FIG. 6B is view which shows electric field equipotential lines in the collector of FIG. 4.
Figure 6A:
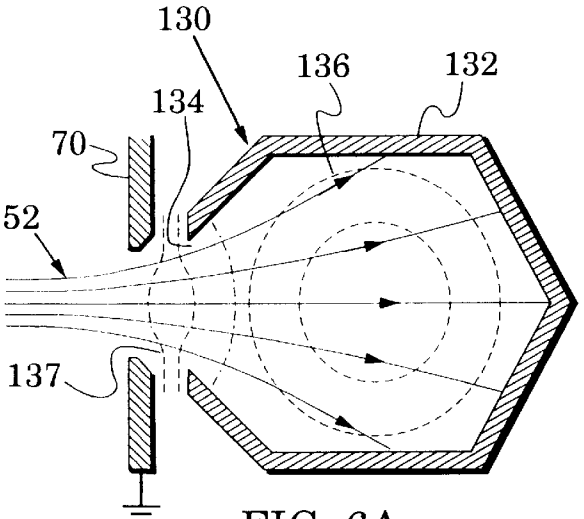
FIG. 6A (PRIOR ART)
FIG. 6A is an axially-sectioned view of a conventional collector which shows the collector's electric field equipotential lines.

FIG. 6A shows a conventional collector 130 adjacent a body 70 of a linear-beam microwave tube. The collector 130 has a cup-shaped collector stage 132 which receives the electron beam 52. In response to the incident electron beam 52, secondary electrons are ejected from the walls of the collector stage 132. In the absence of any control, these secondary electrons are repelled by the depressed voltage of the collector stage 132 and flow through the stage's aperture 134 and into the energy exchange region of the micorwave structure (24 in FIG. 1).

However, the presence of the beam's electrons in the collector stage 132 generates a negative space charge which is indicated by electric field equipotential lines 136 (typical aperture equipotential lines 137 are also shown). This space charge tends to block the flow of the secondary electrons from the aperture 134. Secondary electrons typically have an energy on the order of 50 volts so that the space charge preferably has a depression potential at least this large. Because the space charge depression increases with the volume of the collector stage 132, adequate blocking of secondary electrons often requires large, heavy collector stages.

In contrast, FIG. 6B illustrates electric field equipotential lines 138 which are generated in the collector 100 of FIG. 4 by the depressed voltage V2 on the self-biasing element 102. Otherwise, the elements of FIG. 6B are those described in FIG. 4 with like elements represented by like reference numbers) and, accordingly, they will not be further described for this Figure. The intensity of the electric field is determined by the voltage difference $\Delta V=V_2-V_1$ in accordance with equation (1) above rather than by collector stage size. Thus, a self-biasing element can block the flow of secondary electrons but not impose the size and weight penalty of conventional collectors.

Figure 2B:
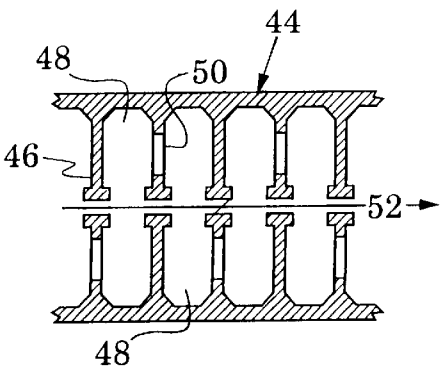
FIG. 2B (PRIOR ART)
FIG. 2B illustrates another conventional slow-wave structure in the form of a coupled-cavity circuit for use in the TWT of FIG. 1.
Figure 2A:
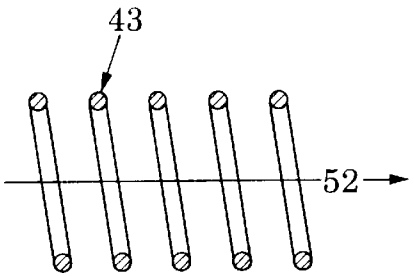
FIG. 2A (PRIOR ART)
FIG. 2A illustrates a conventional slow-wave structure in the form of a helix for use in the TWT of FIG. 1.

In addition to its large size, the conventional collector 130 of FIG. 6A has an operational problem. During operation of the TWT 20 of FIG. 1, positive ions accumulate in the energy exchange region of the slow-wave structure 24 because of the attraction of the space charge of the electron beam (52 in FIGS. 2A and 2B). These ions are then accelerated into the collector stage 132 of FIG. 6A where they partially neutralize the space charge which was blocking the flow of secondary electrons to the energy exchange region of the slow-wave structure. Because the electric field of the collector 100 is generated by the self-biasing element 102 with its depressed voltage $V_2$, this field is not diminished by the presence of positive ions.

When the positive ions of the slow-wave structure are accelerated into a collector, they typically flow along the collector axis and create an axially-located erosion pit where they collide with the collector wall. Preferably, the self-biasing elements of the invention are configured to prevent ion damage to the electron accumulator. Accordingly, FIG. 6C illustrates a collector 140 whose self-biasing element 142 has an annular electron accumulator 144 and an annular base 146. The remaining portions of the collector 140 are those described in the collector 100 of FIG. 4 with like elements indicated by like reference numbers. Accordingly, they will not be further described in detail for this Figure. The annular electron accumulator 144, annular base 146 and annular collector rim 108 are arranged in a coaxial relationship so that the ions from the slow-wave circuit pass through the electron accumulator 144 and the annular base 146.

Controlling Depressed Voltage by Element Location

Figure 7C:
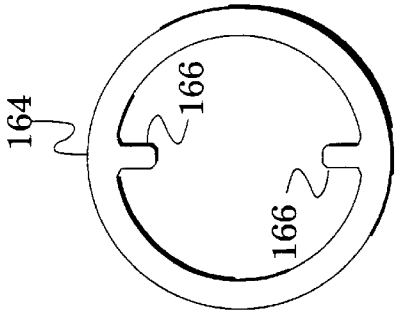
FIG. 7C is a plan view of another electron accumulator for use in the collector of FIG. 7A.
Figure 7B:
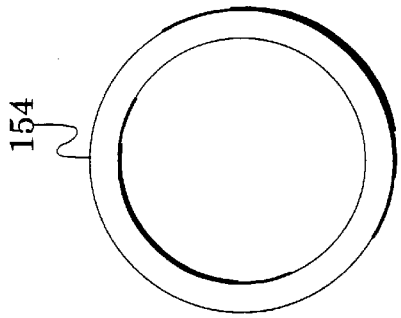
FIG. 7B is a plan view of an electron accumulator in the collector of FIG. 7A.
Figure 7A:
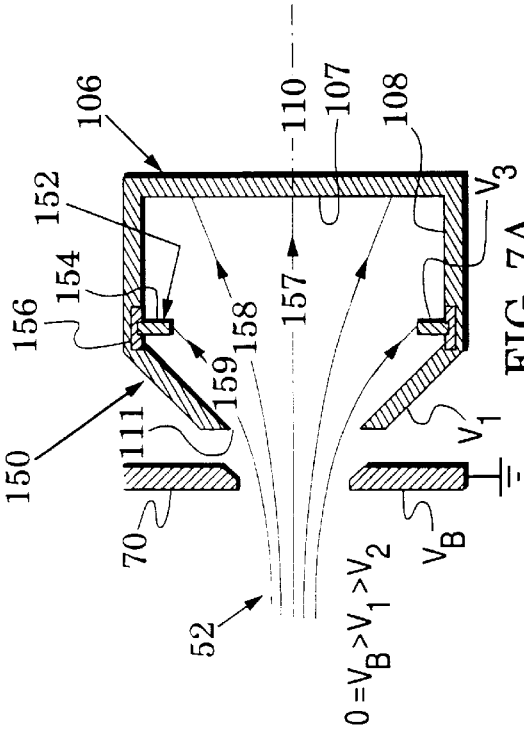
FIG. 7A is an axially-sectioned view of a collector which has another self-biasing element.

FIG. 7A illustrates a collector 150 which is similar to the collector 100 of FIG. 4, with like elements indicated by like reference numbers which will not be further discussed in detail for this Figure. In the collector 150 of FIG. 7A, however, the self-biasing element 102 of FIG. 4 is replaced by an annular self-biasing element 152. The self-biasing element 152 has an annular electron accumulator 154 which is coupled to the collector rim 108 by an annular base 156 and extends radially inward from the rim 108. A plan view of the electron accumulator 154 is shown in FIG. 7B.

As stated above, the electrons of the electron beam 52 have a radial spread of energies. In FIG. 7A, therefore, electrons 157 tend to have greater energy than electrons 158 which, in turn, have greater energy than electrons 159. The electron accumulator 154 will acquire a depressed voltage $V_3$ because it intercepts a portion of the electrons of the electron beam and the depression of $V_3$ will approximate the energy of the incident electrons. Thus, the depression of $V_3$ will be increased as the electron accumulator 154 is positioned closer to the collector axis 110 and as it is positioned further from the collector aperture 111. Of course, the value of $V_3$ can also be decreased from the incident electron energy by decreasing the leakage resistance $R_{leak}$ of the annular base 156 (in accordance with equation (1)). The depressed voltage $V_3$ of the electron accumulator 152 will generate an electric field which is symmetric about the collector axis 110 and which blocks the flow of secondary electrons from the collector aperture 111.

FIG. 7C shows another electron accumulator 164 which is similar to the electron accumulator 154 but also includes a pair of stubs 166 which extend radially inward. The depressed voltage of the electron accumulator 164 can be increased by increasing the length of the stubs 166 so that they intercept higher energy electrons. The number of stubs can be selected and/or positioned circumferentially to also generate radially asymmetric electric fields which can be used to urge electrons away from the collector axis 110.

Controlling Electron Trajectories in a Final Collector Stage

Figure 8B:
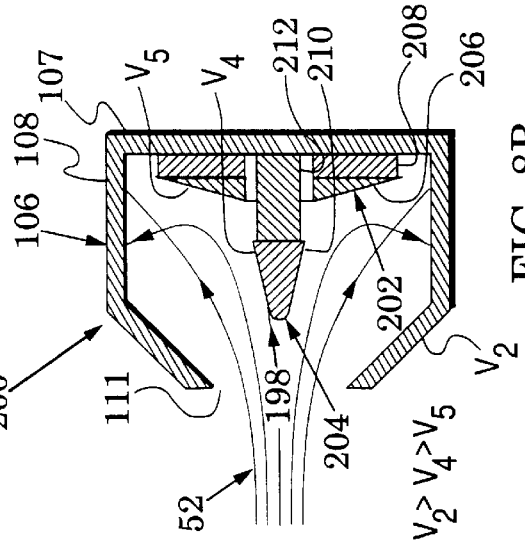
FIG. 8B is an axially-sectioned view of a collector which has coaxially-arranged, self-biasing elements.
Figure 8A:
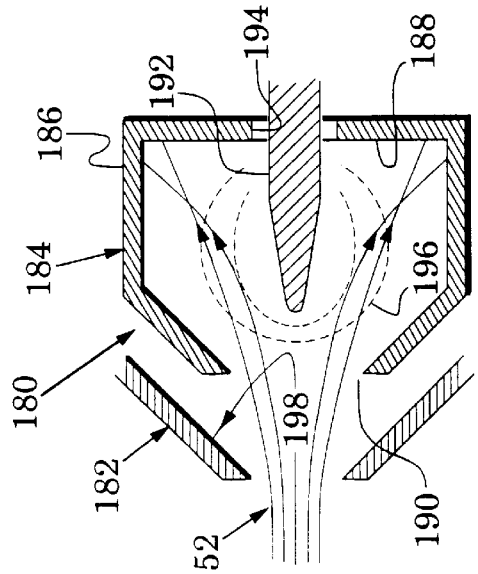
FIG. 8A (PRIOR ART)
FIG. 8A is an axially-sectioned view of a conventional collector which includes a probe.

FIG. 8A illustrates a conventional collector 180 which has an annular collector stage 182 and a cup-like collector stage 184 that receives an electron beam 52. The collector stage 184 includes an annular rim 186 which extends axially from a floor 188 and forms an aperture 190. The collector 180 also includes a probe 192 which extends into the collector stage 184 through a hole 194 in the floor 188. A greatly-depressed voltage (more depressed than the voltage of the collector stage 184) is applied to the probe 192, typically from the cathode power supply 74 of FIG. 3. This voltage generates an electric field which is indicated by equipotential lines 196.

The electric field of the probe 192 generates a radial force which directs electrons of the electron beam 52 radially outward so that they are collected within a short axial distance. This allows the collector stage 184 to be shortened, which reduces its size and weight. The electric field of the probe 192 also blocks secondary electron flow back to the aperture 190.

The probe 192 adds another electrical connection (from a power supply) to the structure of a linear-beam microwave tube. In addition, its electric field repels electrons 198 which are on or near the collector axis. For high linear-beam microwave tube efficiency, these high-energy electrons 198 should be collected by the highly-depressed collector stage 184. Because of the probe 192, they are deflected and collected by the less-depressed collector stage 182.

In contrast, FIG. 8B illustrates a more efficient collector stage 200 which performs the functions of the collector stage 184 in collector 180 of FIG. 8A and does not require connection to an external biasing voltage. The probe 192 of collector stage 184 in FIG. 8A is replaced by a pair of self-biasing elements 202 and 204.

The self-biasing element 202 has an annular electron accumulator 206 which is coupled to the collector floor 107 by an annular base 208. The self-biasing element 204 has an electron accumulator 210 which is coupled to the collector floor 107 by a base 212. The base 212 is configured to position the electron accumulator 210 closer to the collector aperture 111 than is the electron accumulator 206.

The leakage resistances $R_{leak}$ of the bases 208 and 212 are adjusted so that the voltage $V_5$ of the electron accumulator 206 is depressed more than the voltage $V_4$ of the electron accumulator 210 and both are more depressed than the voltage $V_1$ of the annular rim 108 of the collector 106.

In operation of the collector stage 200, the electron accumulator 210 is depressed enough to efficiently collect the high-energy, axially-located electrons 198 of the electron beam 52 but not depressed so far as to repel them to less-depressed collector stages. The higher-depressed electron accumulator 212 radially deflects the other beam electrons so that a short collector stage is facilitated as in the conventional collector 180 of FIG. 8A.

Controlling Electron Trajectories with Asymmetries

Figure 9C:
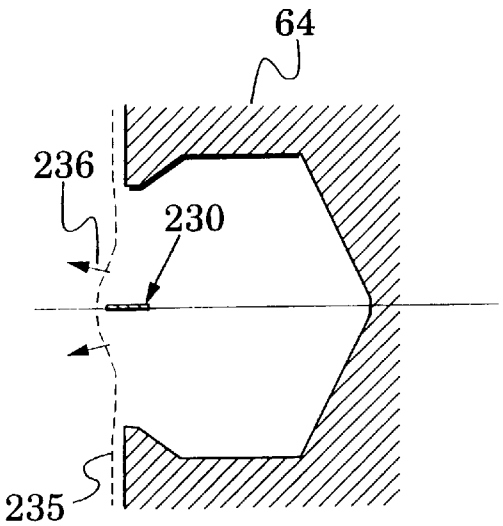
FIG. 9C (PRIOR ART)
FIG. 9C is a top view of the vane and collector of FIG. 9B.
Figure 9B:
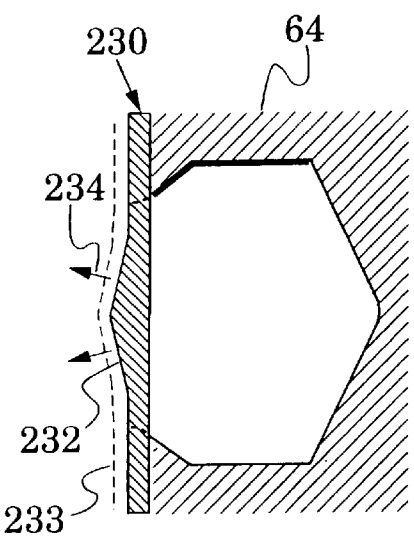
FIG. 9B (PRIOR ART)
FIG. 9B is an axially-sectioned view of a conventional transverse vane in the collector of FIG. 9A.
Figure 9A:
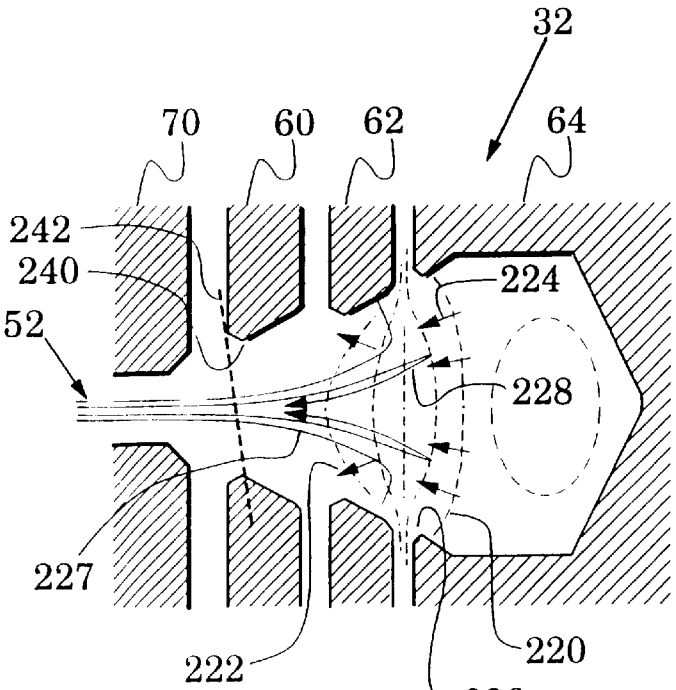
FIG. 9A (PRIOR ART)
FIG. 9A is a view which shows electric field equipotential lines in the conventional collector of FIG. 3.

The multistage collector 32 and the electron beam 52 of FIG. 3 are shown again in FIG. 9A with like elements indicated by like reference numbers and which are not described in detail for FIG. 9. The latter figure also illustrates electric field equipotential lines 220 in the collector 32. Electric field vectors at any point within the collector are orthogonal to the equipotential lines, and the electric force on an electron is in the opposite direction to the electric field due to the negative charge on the electron. Exemplary electric force vectors 222 and 224 are indicated in two axial planes, one on either side of the aperture 226 of the final stage 64. The equipotential lines 220 typically curve forward from the aperture 226 into the collector stage 62 so that the electric force vectors 222 at collector stage 62 have a radially-outward component. Thus electrons 227 in a certain range of energies will be directed outward and collected by the collector stage 62.

However, the cup-like shape of the collector stage 64 typically causes the equipotential lines 220 to curve back from the aperture 226 into the collector stage 64 so that the electric force arrows 224 have a radially-inward component. Those electrons 228 whose energy is sufficient to take them just past the aperture 226 are often, as a consequence, turned and guided axially back into the slow-wave structure (24 in FIG. 1).

A first conventional structure which addresses this problem is the transverse vane 230 that is shown in FIGS. 9B and 9C. The vane 230 goes across the aperture of the bucket stage 64, being attached to the front part thereof, and has sloped surfaces 232 which face radially outward in FIG. 9B. The vane 230 and collector stage 64 form an equipotential region that, in the presence of stage 62 (shown in FIG. 9A) which is operated at a different voltage, is surrounded by equipotential lines exemplified by lines 233 and 235 in FIGS. 9B and 9C respectively.

Electric force vectors 234 are directed away from the surfaces 232 in FIG. 9B and electric force vectors 236 are directed away from the vane 230 in FIG. 9C. Thus, when the vane 230 is incorporated into the collector 32 of FIG. 9A, the electrons 228 that turn around in the vicinity of vane 230, or traverse the vicinity of vane 230 from the opposite direction (from inside the bucket 64 toward the collector entrance), will be urged radially outward rather than inward as in FIG.

9A. This increases their probability of being collected on the depressed collector stages 62 or 60, instead of escaping back to the grounded body 70. (A few electrons traverse the region of the bucket aperture 226 from the opposite direction. These are high-energy secondary electrons which are generated by primary electrons impacting on the collector surface inside the bucket 64. They originate from the small fraction of secondary electrons that have energies approaching the energy of the primary electrons. Because of their high energy, they are not blocked by the space charge depression region in the bucket 64.)

A second conventional structure which addresses the problem of electrons returning along the axis is a slanted aperture. For example, the leading edge of the aperture 240 of the initial stage 60 is slanted as indicated by the broken line 242 in FIG. 9A. This causes the equipotential lines at this stage to have a similar slant, which disrupts the axial symmetry and preferentially directs the electrons towards one side. When the slant is on the aperture of the first depressed stage (e.g., stage 60 in FIG. 9A), the main purpose is to prevent return electrons from the collector from entering the interaction region, thus minimizing their effect on RF performance. When the slant is on the last bucket stage (e.g., stage 64 in FIG. 9A), its purpose is to help collect backstreaming electrons at more depressed stages as well as reduce backstreaming to the body 70 and the interaction region Incorporating a transverse vane 230 may be difficult for mechanical and thermal reasons since the vane should be thin to minimize the electron current it intercepts (any secondary electrons emitted from the vane will be collected at a voltage that is less depressed than the voltage of the vane).

Slanted apertures may prevent some higher-energy electrons from entering a stage because their asymmetric electric field extends forward from the stage causing these electrons to be collected at a less depressed stage due to premature deflection. They are most effectively used with small aperture collectors.

Figure 10B:
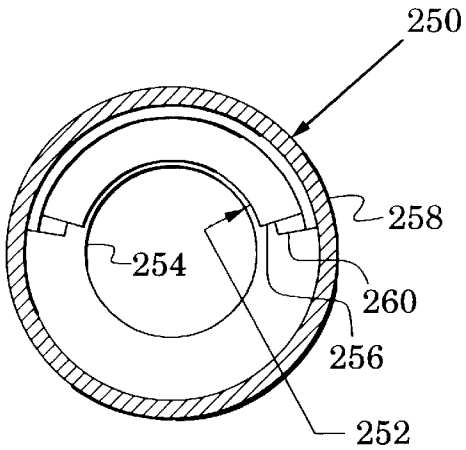
FIG. 10B is a view along the plane 10B—10B of FIG. 10A.
Figure 10A:
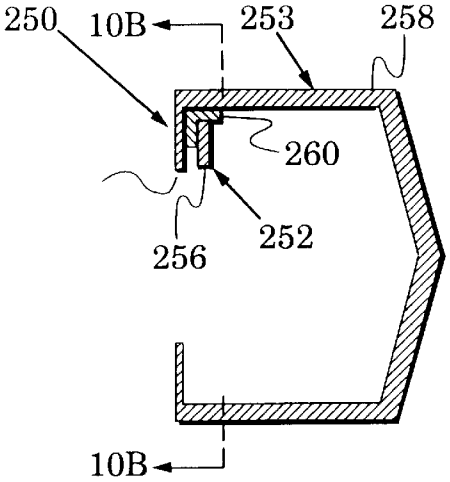
FIG. 10A is an axially-sectioned view of a collector which has another self-biasing element.

In contrast to these conventional structures, FIGS. 10A and 10B show a self-biasing element 252 in a collector 250. The collector 250, which could be the last stage in a multistage collector, has a cup-shaped collector stage 253 (see FIG. 10A) with an aperture 254. The self-biasing element 252 includes a semi-circular electron accumulator 256 which is coupled to a collector rim 258 by a semi-circular base 260. The depressed voltage which develops on the electron accumulator 256 can be adjusted by a) selecting the radial and axial position of the electron accumulator 256 and b) selecting the leakage resistance $R_{leak}$ of the base 260.

The self-biasing element 252 operates similarly to the aperture slant described above, deflecting the electrons preferentially toward one side, but it is more versatile because it can be moved axially as required to avoid rejection of electrons at the aperture 254. The electron accumulator 256 can also include radial stubs such as the stubs 166 of FIG. 7C. These stubs can be used to further shape and modify the asymmetric electric field of the self-biasing element 252, to help disperse electrons away from the vicinity of the collector axis.

Other asymmetric electric fields can be generated by off-axis self-biasing elements on the floor of cup-shaped collector stages. In FIG. 4 for example, another self-biasing element 102 can be positioned on the collector floor 107 but spaced from the collector axis 110.

Controlling Electron Trajectories with an Electric Lens

Figure 11:
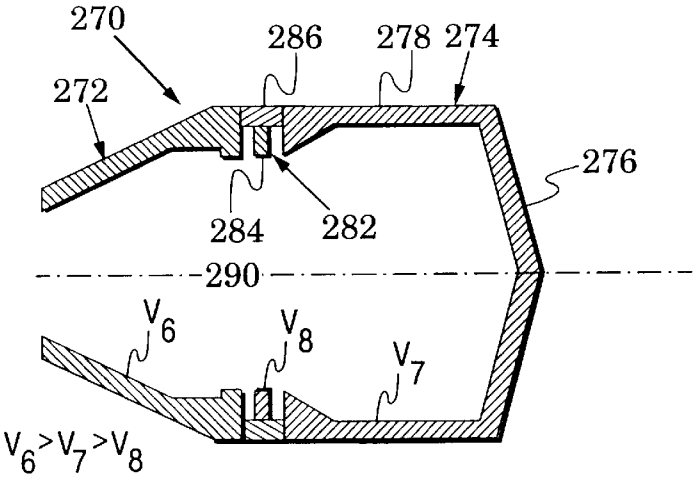
FIG. 11 is an axially-sectioned view of a collector which has another self-biasing element.

FIG. 11 illustrates a collector 270 which has an annular collector stage 272 and a cup-like collector stage 274. The collector stage 274 has a floor 276 and an annular rim 278 which extends axially from the floor. Positioned between these stages is an annular self-biasing element 282 which has an annular electron accumulator 284. The electron accumulator is coupled to the collector stages 272 and 274 by an annular base 286. The voltage $V_7$ of the collector stage 274 is depressed further than the voltage $V_6$ of the collector stage 272. The voltage $V_8$ of the electron accumulator 284 is depressed further than that of the collector stage 274. This is accomplished by appropriate selection of the hole diameter of the annular accumulator 284, or by the use of short intercepting stubs on the accumulator 284 (similar to the stubs 166 in FIG. 7C), and/or by appropriate selection of the leakage resistance $R_{leak}$ of the base 286.

Thus, the annular electron accumulator 284 forms a depressed annular element between a pair of less-depressed annular elements (the collector stage 272 and the collector rim 278). This is the structure of an electric lens. It is well known that an electric lens exerts radially converging forces upon electrons (e.g., see *Theory and Design of Electron Beams*, Pierce, J. R., D. Van Nostrand Company, New York, 1954, pp. 73–75). These converging forces help reduce the beam spread in the collector, allowing collector designs with smaller radial dimensions with less probability for backstreaming (due to smaller aperture sizes in relation to axial lengths). Or, in case of turn-around electrons of the type illustrated by electron trajectory 228 in FIG. 9A, the stronger radially-inward forces may direct the electrons to cross the axis 290 in FIG. 11 for collection at a far-side electrode surface, instead of backstreaming within the region around the axis as in FIG. 9A.

Because they do not require the generation and application of external depressed voltages and because they can be inserted into small axial spaces, self-biasing elements are particularly suited for realizing electric lens effects in linear-beam microwave tube collectors. The radially converging forces of these lenses can also be used for blocking the flow of secondary electrons into the microwave structure (24 in FIG. 1).

While several illustrative embodiments of the invention have been shown and described, numerous variations and alternate embodiments will occur to those skilled in the art. Such variations and alternate embodiments are contemplated, and can be made without departing from the spirit and scope of the invention as defined in the appended claims.

We claim:

1. A collector for collecting electrons of an electron beam in a linear-beam microwave tube, comprising:

a collector stage having a floor and an annular rim extending from said floor;

a first self-biasing element having:

a) a first electron accumulator which has a secondary emission coefficient that is less than one; and b) a first base comprising a ceramic material and coupling said first electron accumulator to said floor; and a second, annular self-biasing element having:

a) a second annular electron accumulator which has a secondary emission coefficient that is less than one; and b) a second annular base comprising a ceramic material and coupling said second annular electron accumulator to said floor;

wherein said second annular self-biasing element surrounds said first self-biasing element.

2. The collector of claim 1, wherein each of said first and second bases comprises a mixture of a ceramic component and a conductive component.

3. The collector of claim 1, wherein each of said first and second accumulators are comprised of titanium carbide.

4. The collector of claim 1, wherein each of said first and second electron accumulators are comprised of carbon.

5. A collector for collecting electrons of an electron beam in a linear-beam microwave tube, comprising:

a cup-like collector stage having a floor and an annular rim extending from said floor; and a self-biasing element having:

a) an annular electron accumulator which has a secondary emission coefficient that is less than one; and b) an annular ceramic base arranged to couple said electron accumulator to said annular rim.

6. The collector of claim 5, wherein said annular electron accumulator includes at least one stub that extends radially inward.

7. A collector for collecting electrons of an electron beam in a linear-beam microwave tube, comprising:

a cup-like collector stage having a floor and an annular rim extending from said floor; and a self-biasing element having:

a) an annular electron accumulator which has a secondary emission coefficient that is less than one; and b) an annular ceramic base arranged to couple said electron accumulator to said annular rim.

8. A collector for collecting electrons of an electron beam in a linear-beam microwave tube, comprising:

a collector stage configured to collect a first portion of said electrons; and a self-biasing element having:

a) an electron accumulator which has a secondary emission coefficient that is less than one and which is positioned in relation to said collector stage so as to intercept a second portion of said electrons; and b) a base arranged to couple said electron accumulator to said collector stage wherein said base is comprised of a ceramic material;

wherein said ceramic material comprises a mixture of a ceramic component and a conductive component;

and wherein said ceramic component is magnesium oxide and said conductive component is silicon carbide.

9. A collector for collecting electrons of an electron beam in a linear-beam microwave tube, comprising:

a collector stage configured to collect a first portion of said electrons; and a self-biasing element having:

a) an electron accumulator which has a secondary emission coefficient that is less than one and which is positioned in relation to said collector stage so as to intercept a second portion of said electrons; and b) a base arranged to couple said electron accumulator to said collector stage wherein said base is comprised of a ceramic material;

wherein said ceramic material comprises a mixture of a ceramic component and a conductive component;

and wherein said ceramic component is aluminum nitride and said conductive component is silicon carbide.

10. A collector for collecting electrons of an electron beam in a linear-beam microwave tube, comprising:

a collector stage configured to collect a first portion of said electrons;

a self-biasing element having:

a) an electron accumulator which has a secondary emission coefficient that is less than one and which is positioned in relation to said collector stage so as to intercept a second portion of said electrons; and b) a base arranged to couple said electron accumulator to said collector stage wherein said base is comprised of a ceramic material; and a conductive film carried on said base and arranged to contact said collector stage and said electron accumulator.

11. The collector of claim 10, wherein said conductive film is carbon.

12. A collector for collecting electrons of an electron beam in a linear-beam microwave tube, comprising:

a collector stage configured to collect a first portion of said electrons; and a self-biasing element having:

a) an electron accumulator which has a secondary emission coefficient that is less than one and which is positioned in relation to said collector stage so as to intercept a second portion of said electrons; and b) a base arranged to couple said electron accumulator to said collector stage wherein said base is comprised of a ceramic material;

wherein said self-biasing element further includes a resistor coupling said electron accumulator and said collector stage.

13. A collector for collecting electrons of an electron beam in a linear-beam microwave tube, comprising:

an annular collector stage;

a cup-like collector stage; and a self-biasing element having:

a) an annular electron accumulator which has a secondary emission coefficient that is less than one and which is positioned between said annular collector stage and said cup-like collector stage; and b) an annular base arranged to couple said electron accumulator to at least one of said annular collector stage and said cup-like collector stage wherein said base is comprised of a ceramic material.

14. The collector of claim 13, wherein said ceramic material comprises a mixture of a ceramic component and a conductive component.

15. The collector of claim 13, wherein said electron accumulator is comprised of titanium carbide.

16. The collector of claim 13, wherein said electron accumulator is comprised of carbon.

17. A method for guiding electrons in a collector of a linear-beam microwave tube, comprising the steps of:

positioning an electron-accumulator member which has a secondary emission coefficient that is less than one, to:

a) as electrons move along a path, intercept a first portion of said electrons to thereby accumulate a negative voltage on said member; and b) with said negative voltage, cause a second portion of said electrons to alter said path; and leaking electrons through a conductive member that contacts both of said electron-accumulator member and said collector to remove electrons from said electron-accumulator member and thereby reduce said negative voltage.

18. The method of claim 17, wherein said leaking step includes the step of forming said conductive member as a discrete resistor.

19. The method of claim 17, wherein said leaking step includes the step of forming said conductive member as a conductive film that is carried over a ceramic member that supports said electron-accumulator member.

* * * * *